US008830798B2

(12) United States Patent
Schmidt

(10) Patent No.: US 8,830,798 B2
(45) Date of Patent: Sep. 9, 2014

(54) CALENDAR MECHANISM

(75) Inventor: Peter Schmidt, Glashuette-Schlottwitz (DE)

(73) Assignee: Glashütter Uhrenbetrieb GmbH, Glashütte (DE)

( * ) Notice: Subject to any disclaimer, the term of this patent is extended or adjusted under 35 U.S.C. 154(b) by 312 days.

(21) Appl. No.: 13/397,086

(22) Filed: Feb. 15, 2012

(65) Prior Publication Data

US 2012/0210812 A1 Aug. 23, 2012

(30) Foreign Application Priority Data

Feb. 17, 2011 (EP) ..... 11154849

(51) Int. Cl.
*G04B 19/24* (2006.01)

(52) U.S. Cl.
USPC ..... 368/37; 368/28

(58) Field of Classification Search
CPC ..... G04B 19/24
USPC ..... 368/28, 37
See application file for complete search history.

(56) References Cited

U.S. PATENT DOCUMENTS

| | | | | |
|---|---|---|---|---|
| 6,108,278 | A * | 8/2000 | Rochat | 368/28 |
| 2003/0151981 | A1* | 8/2003 | Vernay et al. | 368/37 |
| 2005/0018542 | A1* | 1/2005 | Dias | 368/35 |
| 2006/0120219 | A1* | 6/2006 | Ruefenacht | 368/37 |
| 2007/0109916 | A1 | 5/2007 | Bron | |
| 2009/0129207 | A1* | 5/2009 | Watanabe | 368/37 |
| 2009/0201770 | A1* | 8/2009 | Crettex | 368/35 |

FOREIGN PATENT DOCUMENTS

| | | | |
|---|---|---|---|
| CH | 680630 | A3 | 10/1992 |
| EP | 1 351 104 | A1 | 10/2003 |
| EP | 1 785 783 | A1 | 5/2007 |
| FR | 752.359 | | 9/1933 |
| GB | 665847 | | 1/1952 |

OTHER PUBLICATIONS

European Search Report issued on Aug. 23, 2011 in corresponding European Application No. 11 15 4849 (with an English Translation).
U.S. Appl. No. 13/396,897, filed Feb. 15, 2012, Schimidt.
U.S. Appl. No. 13/396,994, filed Feb. 15, 2012, Schimidt.

* cited by examiner

*Primary Examiner* — Amy Cohen Johnson
*Assistant Examiner* — Jason Collins
(74) *Attorney, Agent, or Firm* — Oblon, Spivak, McClelland, Maier & Neustadt, L.L.P.

(57) ABSTRACT

Gear wheel for a clock mechanism, including a toothed gear provided with a homogeneous integral peripheral tooth system with at most 16 teeth in a first meshing level; a first meshing sector that is rotationally fixed with the toothed gear and meshes in a second meshing level, wherein the first meshing level is superposed on a first tooth of the toothed gear; a second meshing sector that is rotationally fixed with the toothed gear and meshes in a third meshing level, wherein the second meshing level is superposed on a second tooth of the toothed gear; a third meshing sector that is rotationally fixed with the toothed gear and meshes in a fourth meshing level, wherein the third meshing level is superposed on a third tooth of the toothed gear.

9 Claims, 6 Drawing Sheets

A
B
C
D
E
F
G
100
12
12'
129
46
13
15
42
18
17
16
20
23
19
22
1
2
11
29
31
30
28
130
128
46'
47
11'
451
129'
13'
45
14
24
21
25
26
0
5
4
3
2
1
6
7
8
9
0

CALENDAR MECHANISM

This application claims priority from European Patent Application No. 11154849.1 filed Feb. 17, 2011, the entire disclosure of which is incorporated herein by reference.

TECHNICAL FIELD

The present invention relates to a multi-level gear wheel and more specifically to a gear wheel for a perpetual calendar mechanism.

PRIOR ART

Annual mechanisms, i.e. those that enable the display of the day of the month to be automatically incremented taking into account months of less than 31 days without requiring any manual intervention to correct these, as well as perpetual mechanisms, i.e. those that additionally take leap years into account for incrementing the day on the last day of the month of February, have long been known.

Perpetual mechanisms use a 12 or a 48 cam, wherein the latter performs a rotation respectively every year or every 4 years, with notches of different depths for months of less than 31 days. In the case of a 12 cam the February notch additionally comprises a Maltese cross indexed every year that defines a lesser depth for leap years. The beak of a lever, which is restored by a spring, acts on the cams used in these day display mechanisms to determine the advance of the day indicator at the end of the month depending on the depth at which this is engaged. This results in a relatively complex construction with a number of important pieces, but is not very reliable in operation, e.g. in the case of shocks. Moreover, this cam system only allows a day wheel and the base movement to be synchronised in a given direction such that the day values can only be incremented and not decremented during an hour adjustment operation.

To overcome these disadvantages, the solution disclosed in patent document CH 680630 proposes, for example, a perpetual mechanism comprising a program wheel, which is driven by protruding teeth of a 24-hour wheel and on which a gear train is arranged so that it is always moved along the number of steps corresponding to the differential between the number of days of the month and 31. This mechanism has no lever, balance or spring at all except for a jumper to index the day wheel. However, the gearing system is very complex with numerous planet wheels fitted with long teeth for indexing readjustments arranged eccentrically on the program wheel and each dedicated to a particular correction. This results in very high production costs because of the highly precise positioning required for the axes in order to guarantee reliable meshing with the 24-hour wheel. Moreover, the space requirement is significant not only with respect to height on the base plate because of the different meshing levels, but also with respect to volume because of the relatively significant diameter of the 24-hour wheel.

Document EP1351104 proposes an alternative to the previous solution where the number of components on the program wheel and the overall thickness of the program wheel are reduced. However, the program wheel is still driven by long teeth arranged on the 24-hour wheel. Moreover, the control device for indexing readjustments of the calendar still comprises numerous planet wheels with teeth of unequal length acting as cam surfaces for sliding elements such that the meshing reliability is not assured on use.

There is therefore a need for gear devices for calendar mechanisms, and in particular perpetual calendars, that are free of these limitations of the prior art.

BRIEF SUMMARY OF THE INVENTION

It is an aim of the present invention to provide an alternative solution to the usual calendar mechanisms with a simplified construction, in which the adjustment of the hour and the day can be synchronised in both directions.

Another aim of the present invention is to provide a solution that minimises energy losses during the different indexing operations, and in particular indexing readjustments at the end of months of less than 31 days.

These aims are achieved in particular by means of a gear wheel 12 for a clock mechanism, characterized in that it comprises:

- a toothed gear 12' provided with a homogeneous integral peripheral tooth system with at most 16 teeth in a first meshing level A;
- a first meshing sector 29 that is rotationally fixed with the toothed gear 12' and meshes in a second meshing level B, wherein the first meshing level 29 is superposed on a first tooth 29" of the toothed gear 12';
- a second meshing sector 30 that is rotationally fixed with said toothed gear 12' and meshes in a third meshing level D, wherein the second meshing level 30 is superposed on a second tooth 30" of the toothed gear 12';
- a third meshing sector 31 that is rotationally fixed with the toothed gear 12' and meshes in a fourth meshing level C, wherein the third meshing level 31 is superposed on a third tooth 31" of the toothed gear 12'.

An advantage of the proposed solution is that only a reduced volume is required on the plate for meshing with a program wheel, such as that used for a calendar mechanism, for example.

Another advantage of the proposed solution is to guarantee a better meshing reliability as a result of an adjustable tooth profile and a superior angular course of each meshing sector of the gear wheel according to the invention compared to a program wheel.

An additional advantage of the proposed solution is to separate the meshing functionality of a wheel associated with the base movement such as the 24-hour wheel, for example, with a clock module such as a calendar mechanism, for example, in such a manner that there is now no need for a long tooth on such a wheel to conduct the respective indexing operations for a calendar mechanism. Consequently, the fact that a wheel is dedicated to meshing with a clock module such as a calendar mechanism, for example, allows a module to be added and respectively replaced without having to modify or at the same time respectively change any of the usual parts of the base movement of a timepiece.

BRIEF DESCRIPTION OF THE FIGURES

Exemplary embodiments of the invention are indicated in the description and illustrated by the attached figures, wherein.

EMBODIMENT(S) OF THE INVENTION

The gear wheel according to the invention preferably forms a perpetual calendar mechanism. However, a person skilled in the art will understand that this gear wheel could also be adapted to simpler mechanisms such as annual or 30 day-month calendar mechanisms, for example, by adjusting the number of meshing levels, or also for other types of clock modules.

Figures 1A, 1B, 1C:
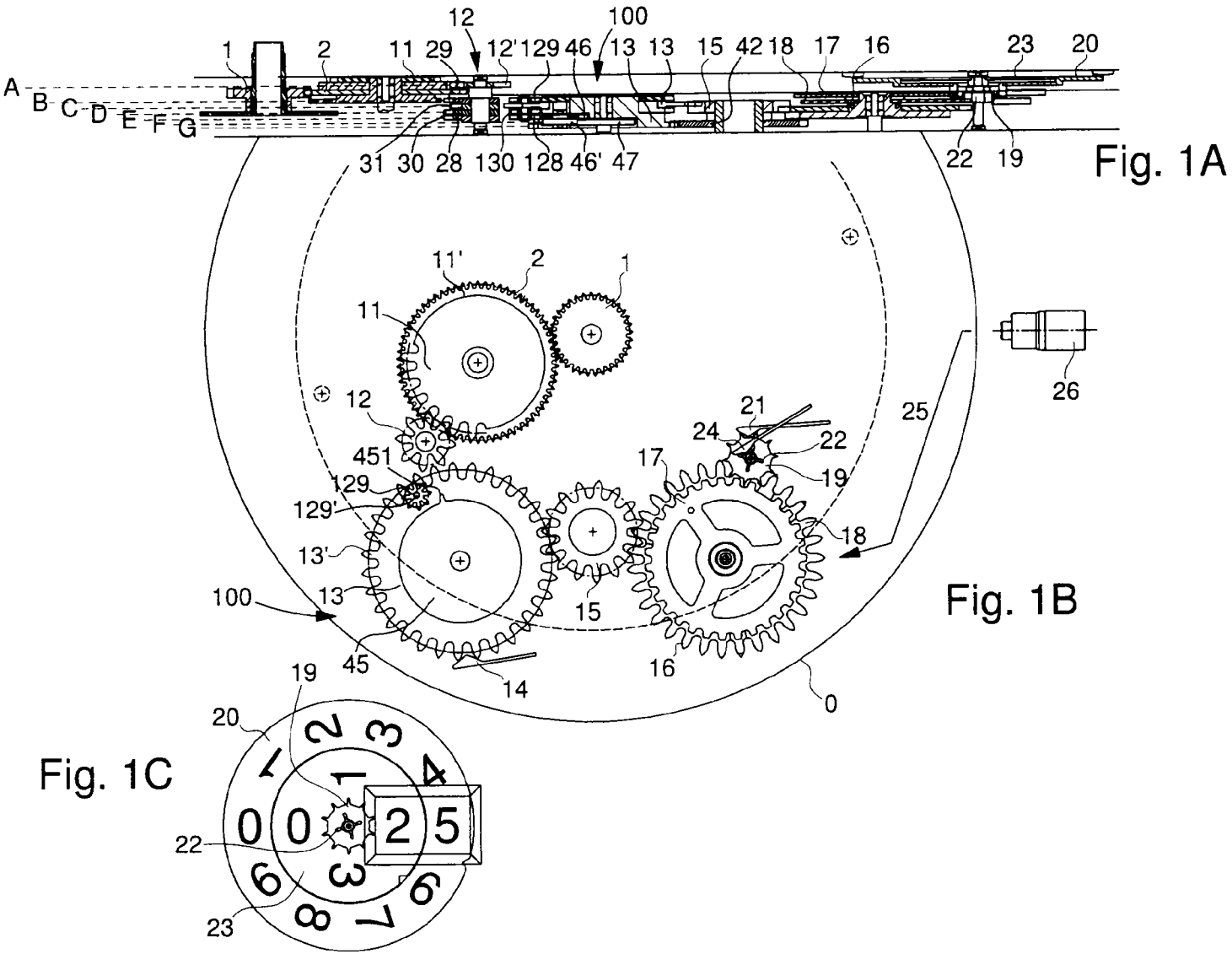
FIG. 1A is a view in partial section of a calendar mechanism using a gear wheel according to a preferred variant of the invention.
FIG. 1B is a partial plan view of the calendar mechanism according to the preferred variant of the invention illustrated in FIG. 1A in particular with a program wheel and a planet wheel.
FIG. 1C is a plan view of the display device of the calendar mechanism using a gear wheel according to the preferred variant of the invention illustrated in FIGS. 1A and 1B.

FIGS. 1A and 1B respectively show a sectional view and a plan view of the drive wheel train for display of the day of the month from the movement onwards, while FIG. 1C shows a classic day of the month display device. FIG. 1B in particular shows the position of this wheel train in relation to the case 0 and demonstrates in particular the operation of the adjustment mechanism of the day values by means the manual day correction actuator 26.

In the following reference is made alternatively to FIGS. 1A and 1B, which could be consulted in combination for better comprehension of the drive wheel train of the calendar mechanism according to the illustrated preferred embodiment. The hour wheel of the movement 1 meshes with a 24-hour wheel 2 consisting of twice the number of teeth. Arranged on this 24-hour wheel 2 is a day meshing segment 11, which here consists of 7 teeth spaced 15 degrees such that the passage from one tooth to the other occurs every hour. This day meshing segment of the 24-hour wheel 11 meshes in a first level A evident in FIG. 3A with a toothed gear 12' of a gear wheel that is arranged on several meshing levels. The toothed gear consists of 8 teeth in this meshing level A. Thus, each day the 24-hour wheel 2 causes the calendar index wheel 12 to perform a complete rotation when meshing with the 7 teeth of the meshing segment 11, i.e. in the space of 8 hours. When the calendar index wheel 12 does not mesh with the toothed meshing segment 11, it is nevertheless resting against a non-toothed segment of the 24 h wheel, given the reference 11' in FIG. 1A, and thus is held in position. The meshing segment of the 24-hour wheel 11 and the calendar index wheel 12 are thus preferably arranged so that this latter performs a complete rotation between 18.00 hours and 2.00 hours in the morning each day and the indexing with the day program wheel 13 takes place between 20.00 hours and midnight.

As can be seen in FIG. 1A, the gear wheel 12 has a plurality of toothed sectors 28, 29, 30, 31 distributed over different meshing levels B, C, D, E. These sectors will be more clearly visible in particular in FIG. 3B, which illustrates them in a perspective view. According to the described preferred embodiment, these toothed sectors are, moreover, consecutive and consequently potentially mesh every hour with the day program wheel 13. FIG. 1B shows meshing level B of the meshing sector 29, the second one down in FIG. 1A, with the program wheel 100. The planet gear 129 rotates around its rotation axis 129' and additionally meshes with the indexing tooth 451 for the month of February, the only one of the program wheel for the month of February 45, integral with the month program wheel 43 evident in the following FIG. 2B. The meshing sector 29 is preferably arranged to mesh with the planet gear 129 between 21.00 hours and 22.00 hours, as will be explained in detail in FIGS. 5A and 5B, for a readjustment from the 29th to the 30th day in the months of February.

The day program wheel 13 comprises a homogeneous day indexing tooth system 13' of 31 teeth (i.e. wherein the height of each tooth and the spacing between each of them is identical), which is, moreover, indexed by pitch by one tooth each day by the wheel train described above starting from the hour wheel 1, i.e. the 24-hour wheel 2, the day meshing segment 11 of the 24-hour wheel and the gear wheel 12. In fact, a meshing sector 31 rotationally fixed with the gear wheel 12 meshes each day, preferably between 23.00 hours and midnight according to the illustrated preferred embodiment, with a corresponding tooth 131 of the day indexing tooth system 13' of the day wheel 13. In contrast to the meshing sector 31 of the gear wheel 12, this tooth 131 is never the same each day and each time corresponds to another tooth of the external day indexing tooth system 13', since it is defined solely in relation to the tooth 31 of the gear wheel 12. The elastic indexing element of the program wheel 14, which comes between two consecutive teeth after each jump, enables indexing to occur by pitch by a single tooth.

Other meshing sectors 28 and 30 of the gear wheel 12, only visible in FIG. 1A for reasons of clarity, serve to conduct additional readjustments for months of less than 31 days in association with corresponding planet gears 128, 130 arranged on the program wheel 100, and more precisely the day program wheel 13. While the planet gear 129 meshes in meshing level B, the other planet gears 128 and 130, the respective rotation axes 128' and 130' of which are integral with the day wheel 13, respectively mesh in levels E and D, as will be evident subsequently in particular on the basis of FIGS. 5, 6 and 7 for indexing from the 28th to the 29th day respectively in the months of February of non-leap years, and for indexing from the 30th to the 31st day for months of less than 31 days. These indexing readjustments preferably take place between 20.00 and 21.00 hours and 22.00 and 23.00 hours respectively.

At the bottom of FIG. 1A there can be seen a meshing level G corresponding to that of an intermediate month control wheel 42 with the month program gear 43, which is indexed at each end of the month by a twelfth of a rotation, i.e. to change the value of the month. The intermediate month control wheel 42 is the last link of a control wheel train for this monthly indexing operation starting from the external day indexing tooth system 13' of the day program wheel 13 and is described further below on the basis of FIGS. 2A and 2B. A fixed wheel 47' is also evident that allows a Maltese cross 46', also more clearly visible in FIGS. 2A and 2B, to perform a quarter turn each year, during which the month program gear 43, with which it is integrated, performs a complete rotation. The Maltese cross 46', which meshes in meshing level F located just above meshing level G, is integral with a leap year indexing gear 46 comprising three teeth in meshing level E, which are clearly visible in FIG. 3B.

At meshing level C it can be seen in FIGS. 1A and 1B that, via an intermediate day wheel 15 arranged coaxially but to be freely rotatable in relation to the intermediate month control wheel 42, the day indexing tooth system 13' meshes with a day wheel 16 also provided with 31 teeth like the day program wheel 13. The intermediate day wheel 15 only constitutes a return for all the indexing movements on the day program wheel 13 which are integrally responded to on the day wheel 16, and conversely all the rotation movements of the day wheel 16 are integrally responded to at the day wheel 13 during adjustment using the manual actuator 26 described further below. Thus, no elastic indexing element is required for indexing the day wheel 16. The units wheel 17 is divided into 31 equal angle sectors, on which 30 teeth and a sector without teeth are located. The units wheel 17 drives a gear for actuating a units display disc 19 every day of the month except one. The units display disc 20 that is integral with the gear for actuating the units display disc 19 is thus indexed by one unit every day except on passage of the 31st day of the month to the first of the following month where only the tens display disc 23 is incremented. The gear for actuating the units display disc 19 comprises 10 teeth and is indexed by pitch by a tenth of a turn because of the elastic indexing elements of the units disc 24, which comes between two consecutive teeth.

The tens display disc 23 is integral with an actuating gear, i.e. the gear for actuating the tens display disc 22, which has the shape of a cross with 4 arms and is indexed by a quarter turn during passage from the 9th to the 10th day, from the 19th to the 20th day, from the 29th to the 30th day, and from the 31st to the 1st day. The jump of a quarter turn is assured by the elastic indexing element of the tens display disc 24, which comes between two adjacent arms of the cross; and the indexing on these day values is assured by long teeth arranged on the tens wheel 18, which is also divided into 31 sectors, but only comprises 4 long teeth, of which 3 are arranged at 9 sector intervals and the 4th following the 3rd for passage from the 31st day to the first of the following month.

The wheel train for display of the day of the month composed of elements with references 16 to 24 from the day wheel 16 to the display discs for units 20 and tens 23 is partially visible in each of FIGS. 1A, 1B and 1C: FIG. 1A shows the whole of the wheel train except for the elastic indexing elements 21 and 24 of each actuating gear 19 and 22 respectively associated with the display disc for units and for tens 20 and 23, FIG. 1B shows a meshing level located below these display discs for units 20 and for tens 23, which are consequently only visible in FIG. 1C.

The adjustment of the day of the month is conducted by means of the manual actuator 26 arranged on the case 0. According to the preferred embodiment described in FIGS. 1A and 1B, the manual actuator for adjustment of the day 26 is a button, which is successively pressed, 30 times at maximum, to reach the desired day. The adjusting mechanism 25, which enables pulses to be transmitted from the button to the day gear 16, is not shown in FIG. 1B for reasons of clarity; however, such mechanisms are known to the person skilled in the art. According to the shown preferred embodiment, as well as for the proposed alternative solution, it is not possible, however, to conduct such an adjustment of the day when one of the meshing sectors 28, 29, 30 or 31 of the gear wheel 12 is engaged with the day program wheel 13 either directly or via the planet gears 128, 129, 130, that is to say between 20.00 and 24.00 hours. In fact, the direct engagement of the gear wheel 12 with the day meshing segment of the 24-hour wheel 11 would then tend to pass these indexing operations on to the hour wheel 1, which is not possible without damaging the normal functioning of the movement.

Figures 2A, 2B:
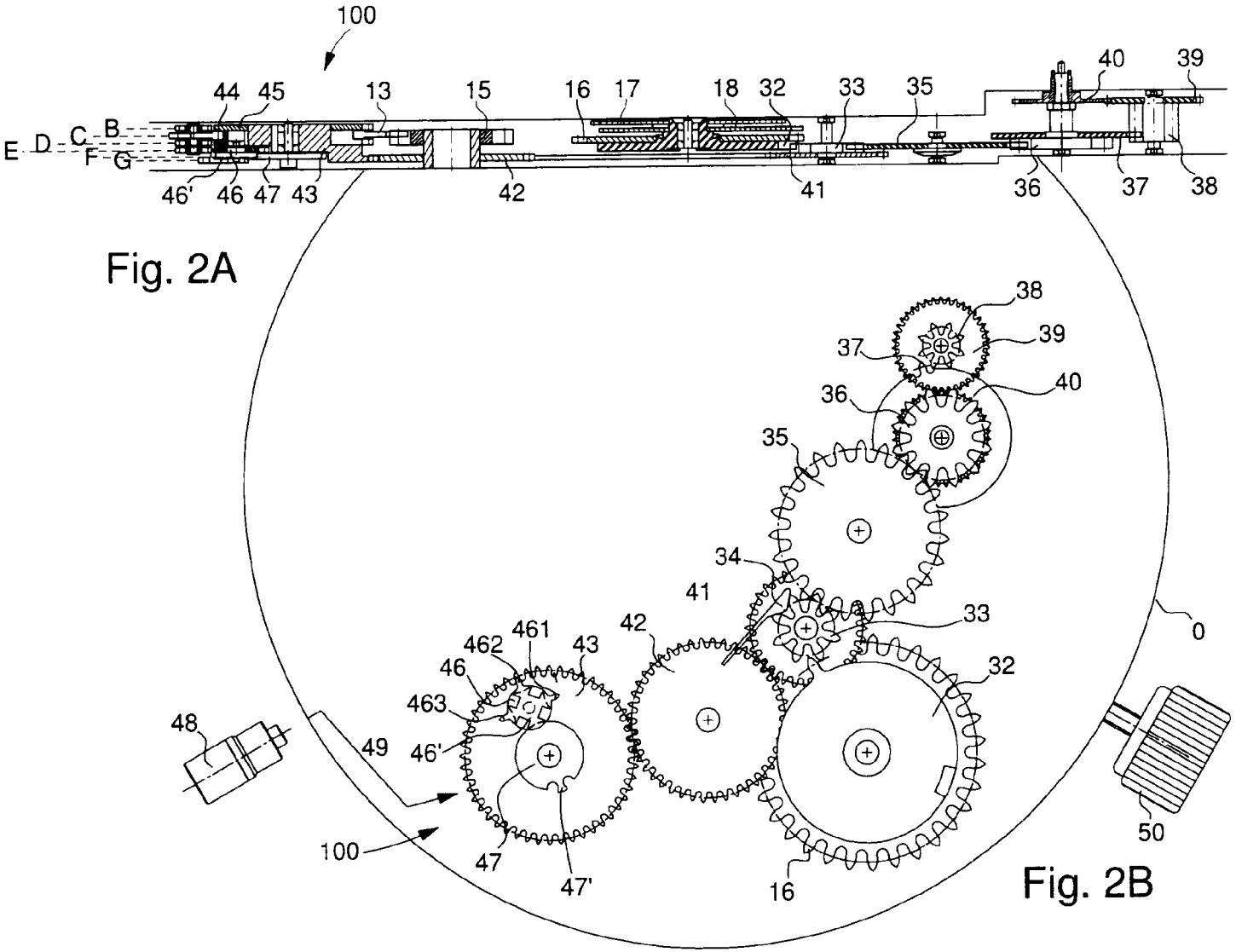
FIG. 2A is another sectional view of the calendar mechanism using a gear wheel according to a preferred variant of the invention, in particular showing the control mechanism of the program wheel, display of months and leap years.
FIG. 2B is the partial plan view of the calendar mechanism using a gear wheel according to a preferred variant of the invention illustrated in FIG. 2A.

FIGS. 2A and 2B respectively show a sectional and a plan view of the calendar mechanism using a gear wheel 12 according to a preferred variant of the invention, in which are described the control wheel trains for positioning the month program gear 43 in order to adequately position the pivoting retractable teeth, as well as the wheel trains for displaying the months and leap years. Two other manual actuators are illustrated at the level of the case 0, the first given the reference 48 at 8 o'clock on the case for adjusting the months, and the second at 4 o'clock on the case 0 in the form of a crown 50 classically arranged, for example, on a pull bar, one of the axial positions of which enables the movement to be rewound and another position the hour and minute hand to be adjusted bidirectionally.

Evident in the central part of FIG. 2A is a gear, on which a monthly indexing tooth 32 visible in FIG. 2B is arranged. This monthly indexing tooth 32 meshes with a monthly indexing gear 33 with 8 teeth rotationally fixed with a month control wheel 4 with 32 teeth, which meshes in meshing level G with the intermediate month control wheel 42 that is coaxial but not rotationally fixed with the intermediate day wheel 15, and which in turn meshes with the month program gear 43 with 48 teeth. The monthly indexing gear 33 performs exactly ⅛ of a turn each month because of the elastic indexing element 34, which comes between two of its consecutive teeth. The gear ratio between the number of the monthly indexing gear 33 and of the month program gear 43 allows this to be indexed by exactly 1/12 of a turn each month.

The monthly indexing gear 33 additionally meshes with an intermediate monthly index wheel with 23 teeth, which in turn meshes with an actuating gear for the months display 36 with 12 teeth. The gear ratio of 8/12 between the monthly indexing gear 33 and the actuating gear for the months display 36 assures that this latter performs exactly a twelfth of a turn at the end of each month. The actuating gear for months display 36 is rotationally fixed with an annual indexing tooth 37, which is positioned on a gear that performs a complete rotation each year. This annual indexing tooth 37 meshes with a leap year actuating gear 38 provided with 8 teeth, which is shifted by 2 teeth, i.e. 90 degrees, during each meshing with the annual indexing tooth 37. The leap year actuating gear 38 is rotationally fixed with an intermediate leap year wheel 39 provided with 39 teeth that meshes with a leap year display wheel 40 that also comprises 39 teeth and is mounted coaxially to the actuating wheel for months 36 such that the indicators of the months and leap years, typically hands pointing at concentric rings arranged on the dial of a watch, can be arranged to rotate around the same motion work in order to improve legibility for the user. The person skilled in the art will understand that the numbers of teeth indicated for the elements forming the wheel trains described in FIGS. 2A and 2B for months display (elements 33-36), the leap year display (elements 37-40) and the control of the position of the month program gear 43 (elements 33, 41, 42, 43) are given by way of example within the framework of the illustrated preferred variant with an adequate meshing efficiency to implement the invention, but should not be considered restrictive.

FIG. 2B clearly shows the leap year indexing gear 46 mounted on the month program gear 43. The leap year indexing gear 46 is integral with a Maltese cross 46', which meshes with the leap year indexing finger 47' arranged on a fixed wheel 47 in level F. Superposed on 3 arms of the Maltese cross are 3 teeth 461, 462 and 463, which mesh in meshing level E to move the day from 28 to 29 when the year is not a leap year.

The month program gear 43 is synchronised to the displayed and indexed month values so that the planet gears mesh to conduct the readjustments necessary at the end of the month. This is the reason why the control wheel train, which according to the illustrated preferred embodiment is formed by elements 15, 16, 32, 33, 41 and 42, enables retroaction from the external day indexing tooth system 13' to the month program wheel 43. The day indexing tooth system 13' of the day program wheel 13 performs at least 1/31 of a turn each day (i.e. 1/31 for normal days, whereas for the last days of months of less than 31 days it performs the additional readjustment required of one or more 1/31 of a turn for months with 30 days and February) to index the month program wheel 43 by a twelfth of a turn after the end of each month. According to the illustrated preferred variant, the indexing of the month program gear 43 takes place at the same time as the gear for actuating the months display 36 is also indexed by 1/12 of a turn, since the indexing of these two gears is caused by meshing with the same element: the monthly indexing tooth 32.

According to the described preferred embodiment of the calendar mechanism, the control wheel train of the month program gear formed from the elements given the references 15, 16, 32, 33, 41, 42 is formed from a first kinematic chain from the day indexing tooth system 13' of the day program wheel 13 to the day wheel 16, which forms the first element of the day display wheel train (16-24), via the intermediate day wheel 15, while a second kinematic chain goes from the day wheel 16 and the monthly indexing tooth 32 to return to the month program wheel 43 arranged coaxially but to be rotationally independent of the day program wheel 13, via the monthly indexing gear 33 and the month control wheel 41, which are rotationally fixed, and the intermediate month control wheel 42. The intermediate gears 15 and 42, i.e. the intermediate day wheel 15 and the intermediate month control wheel 42, are arranged as a single intermediate wheel comprising two coaxial and rotationally independent gears in order to save the maximum amount of space on the plate, e.g. for other clock modules. The intermediate month control wheel 42 meshes in level G with the month program gear 43, whereas the intermediate day wheel 15 meshes in level C with the day indexing tooth system 13' of the day program wheel 13. According to the illustrated preferred embodiment, the intermediate wheels (intermediate day wheel 15 and intermediate month control wheel 42) turn in a contrary direction of rotation to one another since the intermediate day wheel 15 meshes directly with the day wheel 16 and consequently turns in a direction opposed to this, whereas the intermediate month control wheel 42 is driven by the monthly indexing finger 32 integral with the day wheel 16 via the gear formed by references 33, 41 and therefore turns in the same direction as the day wheel 16.

The adjustment of the months is conducted by means of the manual actuator 48 arranged on the case 0. According to the preferred embodiment described in FIGS. 2A and 2B, the manual actuator for adjusting the days of the week 48 is a button, which is successively pressed, 11 times at maximum, to reach the desired month in the year. According to the described preferred embodiment, the manual actuator 48 not only serves to determine the months, but also the year in the 4-year leap year cycle, since there is no dedicated actuator for adjustment of the years. In this case, the maximum number of pulses will be 47 and not 11. In order to overcome this disadvantage, it would be possible in an alternative embodiment to provide another manual actuator on the centrepart to act directly on the tooth system of the gear for actuating the leap year display 38. However, in this case it would have to be assured during adjustment that the tooth system of this actuating gear is not engaged with the annual indexing tooth 37, i.e. preferably not in the month of December or in the month of January, which imposes additional limitations as to the moment when the adjustment must be conducted.

The adjustment mechanism 49, which allows the pulses of the button to be transmitted to the month program gear 43, has not been shown in FIG. 2B for reasons of clarity. However, such mechanisms are known to the person skilled in the art. According to the shown preferred embodiment, as well as in the proposed alternative solution, it is not possible, however, to conduct such an adjustment of the months when the monthly indexing tooth 32 meshes with the monthly indexing gear 33, i.e. during the night passing from the last day of the current month to the 1st of the following month. In fact, the engagement of the indexing tooth 32 would cause the day wheel 16 to rotate, and this would result in an identical movement of the day program wheel 13, the engagement of which with teeth 28, 29, 30, 31 of the indexing gear 12 between 20.00 hours and 24.00 hours would cause the day meshing segment of the 24-hour wheel 11 to rotate. This would then tend to pass these indexing operations on to the hour wheel 1, which is not possible without damaging the normal functioning of the movement, as previously, if the adjustment of the days takes place between 20.00 hours and 24.00 hours.

Figure 3A:
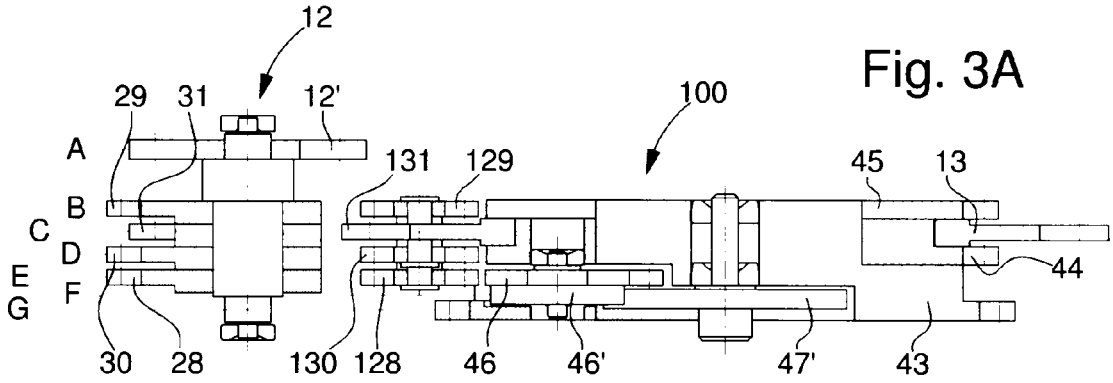
FIGS. 3A and 3B respectively show the sectional view and perspective view of a preferred embodiment of a program wheel and a gear wheel according to the invention.
Figure 3B:
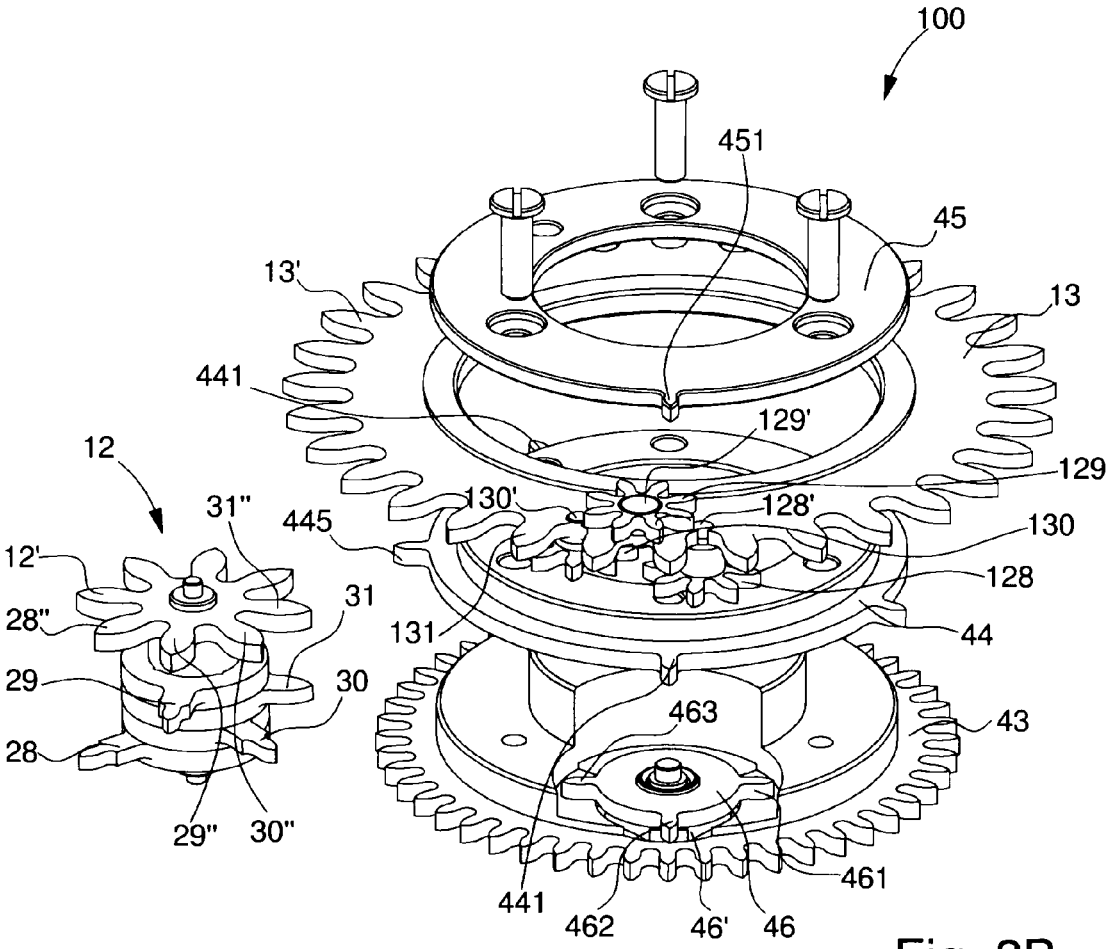

FIGS. 3A and 3B respectively show the sectional view and the perspective view of a preferred embodiment of a program wheel 100 and a gear wheel 12 according to the invention. The gear wheel 12 is driven by the movement by meshing in level A, and the different meshing sectors 28, 29, 30 in meshing levels B, D, E allow indexing readjustments to occur while the meshing sector 31 in meshing level C performs the normal daily indexing operations, preferably between 23.00 hours and midnight. The meshing sectors 28, 29, 30 and 31, which according to the illustrated variant each comprise a single tapered tooth, are superposed on teeth 28", 29", 30" and 31" of the toothed gear 12' of the gear wheel 12 that are arranged consecutively in level A. The meshing levels F and G only concern the program wheel 100 and respectively allow indexing of the leap year index wheel 46 by the Maltese cross 46' meshing on the pawl of a fixed wheel 47 and indexing each month of the program wheel 43 by a twelfth of a turn. According to the described embodiment, the meshing sector 29 is located in level B, meshing sector 30 is located in level D and meshing sector 28 in level E. Such a configuration of meshing levels D, E and B respectively on either side of the day meshing level C is advantageous to enable the planet gears 128, 129, 130 to be positioned set back from consecutive teeth of the external day indexing tooth system 13' of the day program wheel 13, as illustrated in FIG. 3B, because the tooth system of the planet gears can then go past the rotation axis of the adjacent planet gear.

As is evident in FIG. 3B, the first, second and fourth meshing sectors 28, 29, 30 are identical, with a double tooth system for each of these sectors compared to teeth 28", 29", 30" of the toothed gear in meshing level A, on which they are superposed in their respective meshing level E, B and D to assure a better meshing reliability. The meshing sector 31, which is superposed on tooth 31" of the toothed gear 12', has an identical profile to this tooth 31". It is thus distinguished from meshing sectors 28, 29 and 30 and makes it easy to pinpoint which is the day meshing level—meshing level C—with the day indexing tooth system 13' of the day wheel 13.

The month program wheel 43 is mounted coaxially and rotationally fixed with a program gear for the months of February 45 in meshing level B and a program gear for months of less than 31 days 44 in meshing level D, so that no dedicated wheel train is necessary for each of these two indexing readjustments. The program gear for the months of February 45 comprises a single tooth 451 and the program gear for months of less than 31 days 44 comprises 5, each corresponding respectively to the months of February 441, April 442, June 443, September 444 and November 445. These teeth are located on the 2nd, 4th, 6th, 9th and 11th of twelve angle sectors corresponding to each month. The program gear for months of less than 31 days 44 is therefore arranged as a gear with 12 teeth, 7 of which would be omitted, on the sectors corresponding to the months of less than 31 days. Moreover, the tooth corresponding to the month of February of the program gear for months of less than 31 days 441 and the tooth of the February program gear 451 are superposed and identical in order to facilitate assembly of the different program gears by easily verifying the required alignment and also to limit the machining costs as a result of the similarity of the shape of the teeth used for each indexing readjustment.

Three planet gears 128, 129, 130 are evident in FIG. 3B, each of these being provided with eight teeth and having rotation axes integral with the day program wheel 13. These planet gears 128, 129, 130 are all identical and their rotation axes 128', 129', 130' are located between consecutive teeth of the day indexing tooth system 13' of the month program wheel 13, so that the tooth system of the meshing sectors 28, 29, 30 can effectively drive that of the planet gears 128, 129, 130 in both directions and along an angular distance corresponding to 1/31 of a turn of the day program wheel 31, and are also located at an equal distance from the centre of rotation of the day program wheel 13. The depth in relation to the tips of the teeth of the indexing tooth system 13' is determined so that it allows a good engagement with the tooth systems of each of the meshing sectors 28, 29, 30. Such a configuration of the rotation axes 128'. 129', 130' on the same arc of a circle is possible due to the fact that the tooth systems of the program gears for months of less than 31 days 44, the program gear for the months of February 45 and the leap year program gear 46 are identical and superposed during the months of February for non-leap years. The planet gears 128, 129, 130 mesh with the tooth system of these gears that are rotationally fixed with the month program wheel 43 to conduct indexing readjustments at the end of the month. According to the described preferred embodiment, each of the planet gears 128, 129, 130 comprises 8 teeth to improve the meshing efficiency, and such an arrangement of these wheels between consecutive teeth of the month program gear is only possible if the wheels 128 and 130 are located on either side of the day meshing level C, on which the third meshing sector 31 of the gear wheel 12 meshes directly with the external day indexing tooth system 13' every day so that the tooth systems of each planet gear 128, 129 and 130 can span the rotation axis of an adjacent gear. It can be seen in FIG. 3B, for example, that the tooth system of the planet gear 129 spans the rotation axes 128' and 130' of planet gears 128 and 130.

The program wheel 100 illustrated in FIGS. 3A and 3B is therefore intended for a perpetual calendar mechanism with a first indexing readjustment in meshing level B for indexing from the 29th to the 30th day in the month of February by means of the meshing sector 29, which cooperates with planet gear 129 and the indexing tooth of the month of February 451 to advance the day program wheel 13 by one tooth; a second indexing readjustment meshing into a second meshing level D for indexing from the 30th to the 31st day for months of less than 31 days by means of the meshing sector 30, which cooperates with the second planet gear 130. The third indexing readjustment is not an annual indexing operation, since it only takes place in months of February that only comprise 28 days. This indexing operation occurs in a third meshing level E by means of the meshing sector 28, which cooperates with the third planet gear 128. The day indexing tooth system 13' of the day program wheel 13 itself meshes in a fourth meshing level C.

The leap year program gear 46 of the illustrated program wheel comprising three teeth 461, 462, 463 is integral with a Maltese cross 46' mounted to pivot on the month program wheel 43 and which meshes every year with the pawl for leap years 47 in the meshing level F. To facilitate the assembly of the program wheel 100 and the machining of the meshing segments of the corresponding gear wheel 12, the teeth of the leap year program gear 461, 462, 463 are identical and superposed on the teeth corresponding to the month of February of the program gear for months of less than 31 days 441 and on the tooth of the February program gear 451 in months of February of non-leap years.

Therefore, the illustrated program wheel 100 extends over a total of 6 meshing levels from B to F. However, the person skilled in the art will understand that the invention is equally applicable to an annual calendar mechanism by omitting meshing levels E and F for leap years. Similarly, the gear wheel is arranged over 5 meshing levels from A to E, but could consist of only 4 for an annual calendar mechanism.

Figure 4:
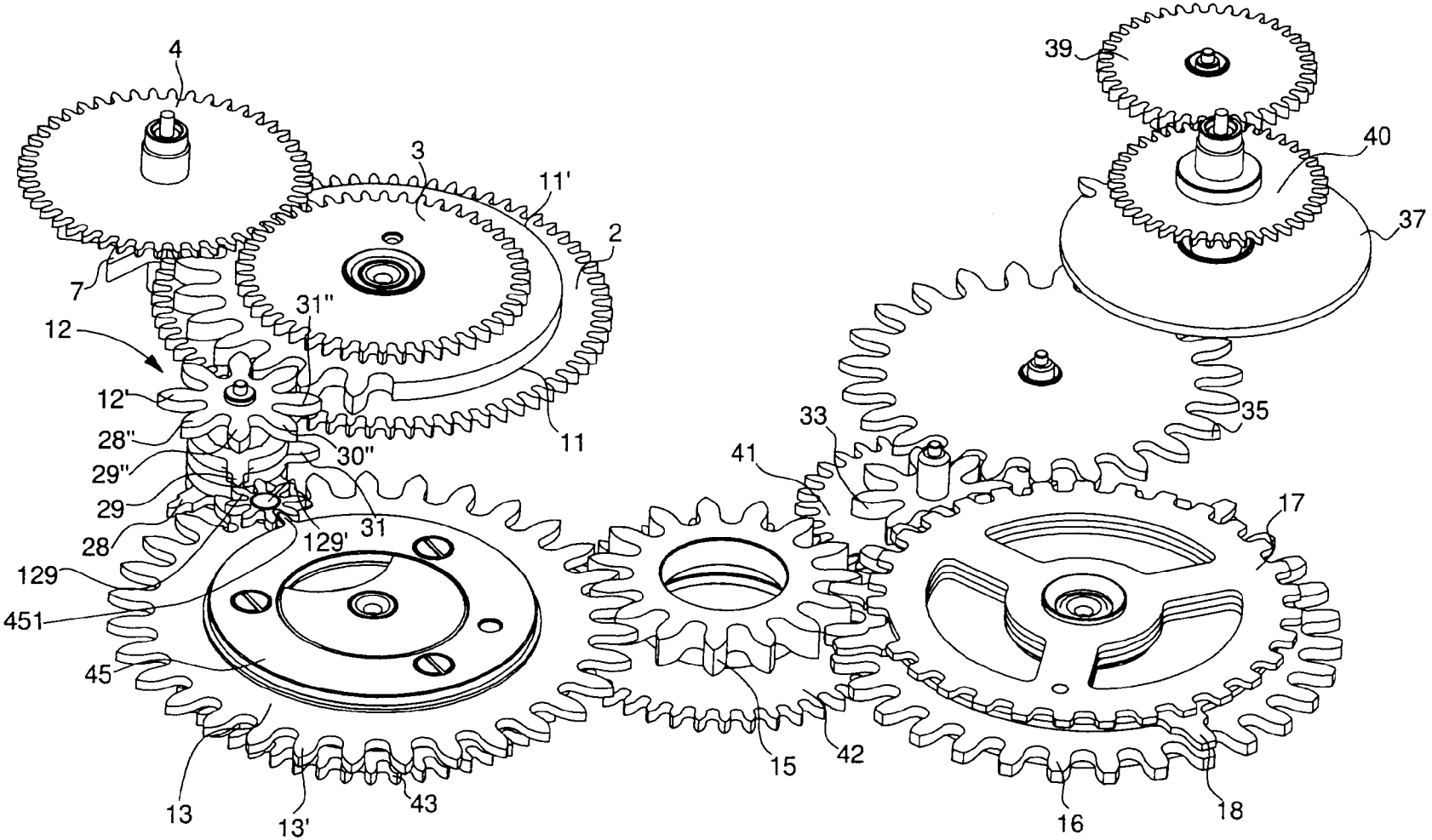
FIG. 4 is a perspective view of the calendar mechanism using a gear wheel according to a preferred variant of the invention using the preferred embodiments of different modules illustrated in the preceding figures.

FIG. 4 shows a perspective view of the calendar mechanism according to the preferred embodiment of the invention illustrated by the different previous figures. From the hour wheel 1 at the centre of the figure, it is possible to see the wheel train leading to the day program wheel 13—of which only the upper meshing level B is visible with the planet gear 129 that is movable around its rotation axis 129' located slightly below the Maltese cross between consecutive teeth 29' and 30' of the day indexing tooth system 13', and the indexing tooth for the month of February 451—by means of the 24-hour wheel 2 and the day meshing segment 11 with 7 teeth, which meshes with the toothed gear 12' of the gear wheel 12.

During each meshing with one of the meshing sectors 28, 29, 30 or 31 of the gear wheel 12 of the calendar the day program wheel 13 performs a 1/31 of a turn. The day wheel 16 is caused to rotate at the same angle by means of the intermediate day wheel 15. Above the day wheel 16 can be seen the units wheel 17 and the tens wheel 18, the 4 long teeth thereof clearly visible arranged at the level of the 9th, 19th, 29th and 31st tooth of the tens wheel 18, the 31st tooth of the units wheel 17 being hollowed out. The day display mechanism is not shown for reasons of clarity.

The wheel train for display of the day of the month is not shown in its entirety in FIG. 4 either, since the respective display discs and the indexing elements (references 20-24 visible in FIG. 1C) and the monthly indexing tooth 32 that is coaxial and rotationally fixed with the day gear are concealed under the day wheel 16. However, the monthly indexing gear 33 is visible that enables the month control wheel 41, with which it is rotationally fixed, to drive the rotation of the month program gear 43, the tooth system of which is barely visible under that of the day indexing part 13' of the day wheel, by means of the intermediate month control wheel 42, and which also meshes with the wheel train for months display.

At the top of FIG. 4 the intermediate monthly index wheel 35 is visible that meshes with an actuating gear for months display 36 concealed under the monthly indexing tooth 37, with which it is coaxial and rotationally fixed. The monthly indexing tooth 37 performs a complete turn in one year and meshes with the actuating gear for leap year display 38 that is coaxial and rotationally fixed with an intermediate leap year wheel 39, which meshes with the leap year display wheel 40 with an equal number of teeth. The leap year display wheel 40 is arranged coaxially to the actuating gear for months display to enable better legibility for the user of the watch.

Figure 5A:
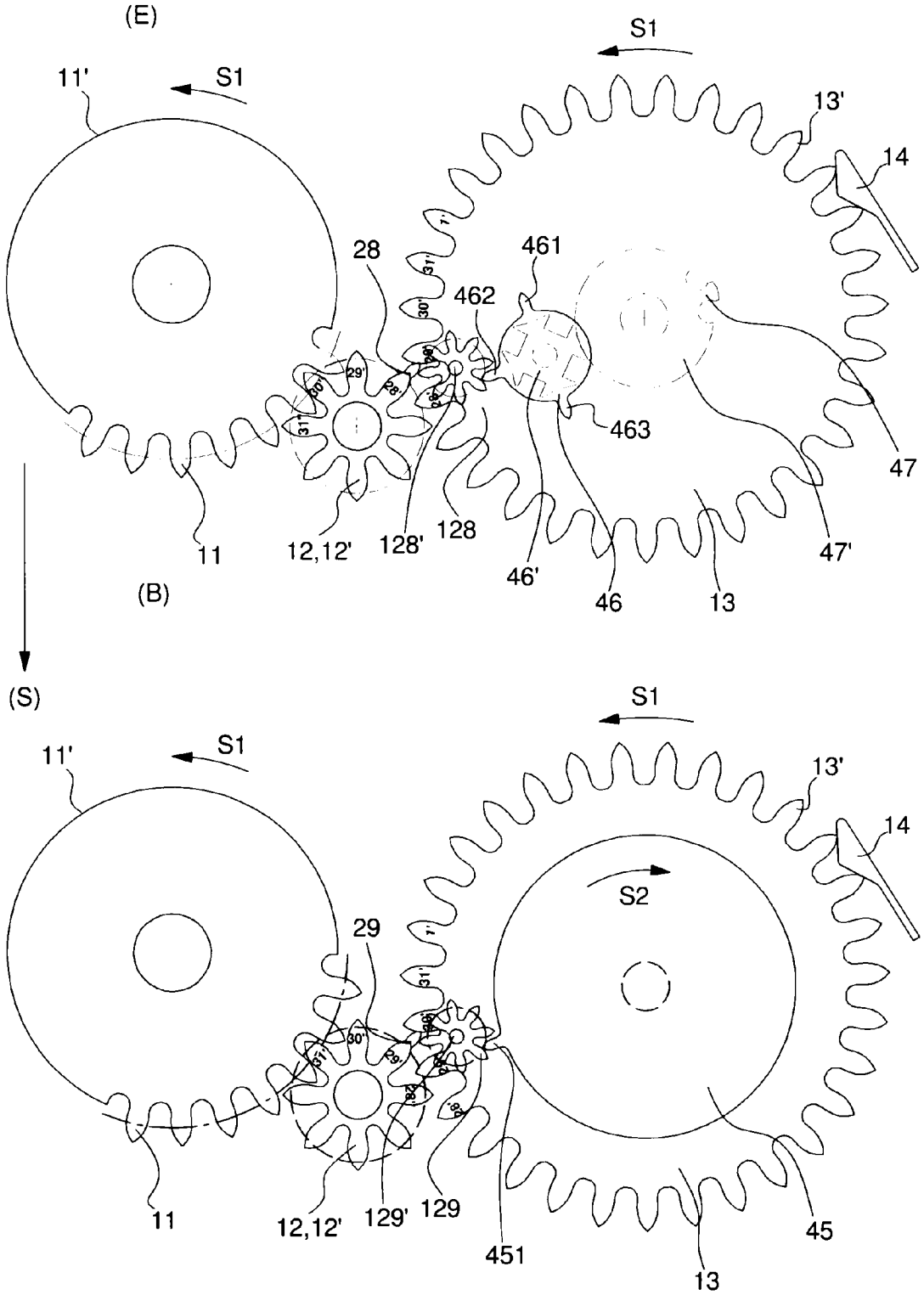
FIGS. 5A and 5B show the different indexing sequences respectively for the two first planet wheels, and the third planet wheel and the indexing tooth system on their respective meshing levels for a perpetual calendar mechanism using a gear wheel according to a preferred embodiment illustrated in FIG. 5 on a 28th February of a non-leap year.

FIG. 5A shows the two first indexing sequences for a perpetual calendar mechanism according to the preferred embodiment illustrated in the figures on a 28th February of a non-leap year. For such a day, the calendar mechanism must readjust by 3 day values, which it does by meshing in the respective levels E, B and D; the figure shows the first readjustment in level E at 20.00 hours and the second readjustment in level B at 21.00 hours.

The top figure shows the day indexing segment 11 as well as the position of the different teeth 28", 29", 30", 31" superposed in meshing level A at meshing segments 28, 29, 30 and 31 in their respective meshing levels E, B, D, C on a 28th February at 20.00 hours. At this time the meshing segment 28 of the gear wheel 12 located under the tooth 28" of the day index wheel in meshing level A meshes in level E with the planet gear 128 mounted to pivot around a rotation axis 128' integral with the day program wheel 13. According to the illustrated preferred embodiment, the rotation axis 128' of the pivoting retractable tooth 128 is located slightly below the hollow between the consecutive teeth 28' and 29' of the day indexing tooth system 13'. The planet gear 128 additionally meshes with the second tooth 462 of the leap year indexing gear 46 integral with the Maltese cross 46' indexed once a year by means of the fixed leap year indexing finger 47 that is itself integral with a fixed wheel 47. According to the illustrated preferred embodiment, the fixed wheel 47 is coaxial to the month program gear 43 and the day program wheel 13'.

As a result of the above arrangement and the cooperation of the tooth system of the planet gear 128 with the tooth 462 of the leap year indexing gear 46 and the tooth system of the meshing segment 28, which can preferably comprise one or two teeth, the day program wheel 13 is driven 1/31 of a turn in the direction of rotation S1 identical to that of the 24-hour wheel 2, the clockwise direction of the hands of a watch here, for example, according to this view of FIG. 5A. The elastic indexing element of the day program wheel 14 allows the day indexing tooth system 13' to be indexed, which then meshes onto the day display wheel train (see references 15 to 24 illustrated in the other figures) by pitch by precisely 1/31 of a turn in direction S1.

Following down arrow S that indicates the direction in which the indexing sequences proceed for the end of the month of February from the top of FIG. 5A, we come to a second illustration showing a sectional view of the program wheels for the days 13 and the months 43 on meshing level B, in which the meshing segment 29 of the gear wheel 12 superposed on the tooth 29" of the day index wheel in meshing level A meshes with the pivoting retractable tooth 129 of the day program wheel 13 that is mounted to pivot around its rotation axis 129' integral with the day program wheel 13. According to the illustrated preferred embodiment, the rotation axis 129' of the planet gear 129 is located slightly below the hollow between the consecutive teeth 29' and 30' of the day indexing tooth system 13". This sequence takes place at 21.00 hours when the 24-hour wheel 2 has brought forward the day meshing segment of the 24-hour wheel 11 by one tooth and caused the day index wheel 12 to rotate one eighth of a turn to mesh onto the tooth 29" following tooth 28". It is evident that the indexing tooth for the month of February 451 in level B is identical to and superposed on the leap year indexing tooth 462 illustrated previously at the top of FIG. 5A in meshing level E, and this arrangement enables the day indexing gear 13' to rotate a 1/31 of a turn in the same direction S1 as a result of the cooperation of the tooth system of the planet wheel 129 with the tooth 451 for indexing the month of February and with the tooth system of the meshing segment 29, which can preferably comprise one or two teeth and preferably the same number of teeth as meshing segment 28. The elastic indexing element of the day program wheel 14 enables the day indexing gear 13' to be indexed to rotate once again precisely 1/31 of a turn in direction S1. The direction of rotation S2 opposed to direction of rotation S1 itself corresponds to that of the month program wheel 43, of which the program gear for the month of February 45 is rotationally fixed. However, according to the described preferred embodiment the indexing of the month program wheel 43 only takes place when passing from the 31st day of the month to the 1st day of the following month.

Figure 5B:
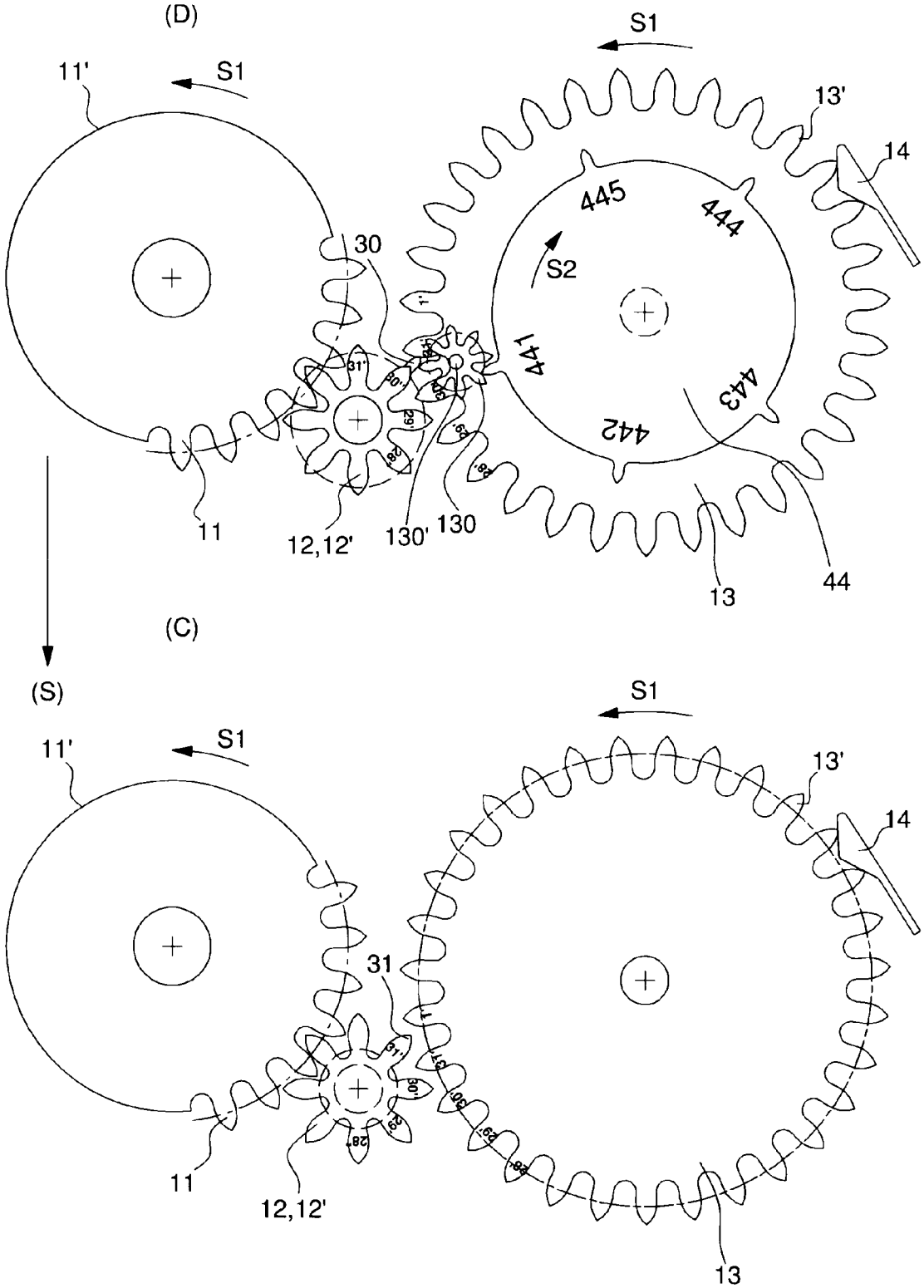

The third and last indexing readjustment, which takes place in meshing level D, is illustrated in FIG. 5B that shows a sectional view of the program wheels for the days 13 and the months 43 along meshing level D, in which the meshing segment 30 of the gear wheel 12 superposed on the tooth 30" in meshing level A meshes with the planet gear 130 of the day program wheel 13 that is mounted to pivot around the rotation axis 130' integral with the day program wheel 13. According to the illustrated preferred embodiment, the rotation axis 130' is located slightly below the hollow between the consecutive teeth 30' and 31' of the day indexing tooth system 13' and on the same arc of a circle in relation to the centre of rotation of the day program wheel 13 as rotation axes 128' and 130'. This sequence takes place at 22.00 hours when the 24-hour wheel 2 has once again brought forward the day meshing segment of the 24-hour wheel 11 by one tooth and caused the day index wheel 12 to rotate one eighth of a turn to mesh onto tooth 30" following tooth 29" on the day index wheel 12. Similarly to the preceding illustrations of FIG. 5A in meshing levels B and E, in level D the indexing tooth 441 is identical to and superposed on the teeth 462 and 451 in levels E and B respectively, and this arrangement in level D enables the day indexing gear 13' to be driven to rotate one 1/31 of a turn in the same direction S1 as a result of the cooperation of the tooth system of the planet wheel 130 with the indexing tooth 441 of the gear 44 for months of less than 31 days, for the month of February here, and also with the tooth system of meshing segment 29, which can preferably comprise one or two teeth and preferably the same number of teeth as the other meshing segments 28 and 29. The four other teeth 442, 443, 444 and 445 that are identical to tooth 441 respectively correspond to the indexing tooth for readjustment from the 30th to the 31st days in the months of April, June, September and November, similarly from 22.00 hours to 23.00 hours for the last days of these months.

The elastic indexing element of the day program wheel 14 enables the rotation of the day indexing gear 13' to be indexed once again by pitch by precisely 1/31 of a turn in the direction of rotation S1 for this last indexing readjustment. The direction of rotation S2 opposed to direction of rotation S1 itself corresponds to that of the month program wheel 43, of which the program gear for months of less than 31 days is also rotationally fixed like the gear for the months of February 45. However, according to the described preferred embodiment the indexing of the month program wheel 43 only takes place when passing from the 31st day of the month to the 1st day of the following month.

As can be seen in particular in the different illustrations of FIG. 5A, all the planet gears 128, 129, 130 preferably have the same geometric shape, which substantially simplifies the manufacture of the day program wheel 13, on the one hand, and also the fabrication of replacement parts, which do not require any machining of dedicated elements for adjustment of the day of the month. The simple and homogeneous geometric shape for each of the planet gears 128, 129, 130 in combination allows the use of indexing gears (gears for the month of February 45 and months of less than 31 days 44) with tooth systems that are also homogeneous, as already discussed above, in each level for indexing readjustment (B, D, E). Hence, the complexity of the whole of the proposed calendar mechanism is greatly reduced in relation to usual mechanisms. The planet gears 128, 129, 130 preferably comprise 8 teeth and mesh with meshing segments 28, 29, 30, each having 2 teeth according to the illustrated preferred embodiment, in their respective meshing level E, B, D.

According to an illustrated preferred embodiment, the meshing segments 28, 29 and 30 each only comprise a single tooth that is sufficiently tapered to mesh with the tooth system of each planet gear 128, 129, 130 and is also superposed on a tooth 28", 29", 30" of the day index wheel 12. This solution allows the machining of the meshing segments 28, 29, 30 to be simplified. In order to improve the meshing reliability, in an alternative embodiment a second tooth could be provided in each meshing sector. In this case, the two teeth of the meshing sector would be located on either side of the corresponding tooth 28", 29" and 30" of the day index wheel 12 and not precisely underneath, even if the meshing segment in its entirety sits in a fully superposed position relative to teeth 28", 29" and 30" of the day index wheel 12.

In FIGS. 5A and 5B of the 31 teeth of the day program wheel 13 only the first tooth of the day indexing tooth system 13' as well as the 28th to 30th teeth, respectively given the references 1', 28', 29', 30', have been indicated as well as the tooth 131, which cooperates with the meshing segment 31 superposed on tooth 31" of the gear wheel 12 for indexing from the 31st day to the first of the following month in the described example when passing from 28th February to 1st March in a non-leap year. In the illustrated preferred embodiment, the meshing sector 31 differs from the other meshing sectors dedicated to readjustment (given the references 28, 29, 30) in that it has exactly the same shape as tooth 31" of the gear wheel 12, on which it is superposed, while the other meshing segments each have a tapered tooth to mesh with the planet gears that have a thinner tooth structure.

The illustration at the bottom of FIG. 5B shows the last indexing sequence of the month, which follows the three previous indexing readjustments for 28th February of a non-leap year, but which also takes place all the other days of the year from 23.00 hours to midnight. The same arrow S as in the previous FIG. 5A for the last indexing of the month is evident pointing downwards to indicate the direction in which the indexing sequences proceed.

This illustration shows the day program wheel 13 in the meshing level C located just above level D in the illustrated preferred embodiment in particular in FIGS. 1A/B and 2A/B, and in which the meshing segment 31 of the gear wheel 12 meshes with a tooth 131 of the day indexing tooth system 13' of the day program wheel 13. This sequence takes place at 23.00 hours when the 24-hour wheel 2 has once again brought forward the day meshing segment of the 24-hour wheel 11 by one tooth in relation to the illustration at the top of FIG. 5B, and has caused the gear wheel 12 to rotate one eighth of a turn to mesh onto the tooth 31" following tooth 30" in level A on the toothed gear 12'.

Once the day of the month has been indexed to 1st March at midnight, when the toothed gear 12' has performed an additional eighth of a turn, just as all the meshing sectors 28, 29, 30, 31, with which they are rotationally fixed, the meshing sector tooth 31 no longer meshes with the day indexing gear 13'. The gear wheel 12, which preferably contains 8 teeth in meshing level A with the day meshing segment 11, of which teeth 28", 29", 30" and 31" are superposed on meshing sectors 28, 29, 30 and 31 in the respective meshing levels E, B, D, C with the day program gear 13, will continue to mesh with the remaining teeth of the meshing segment 11 without this having any influence on the movement of the day program wheel 13. The day indexing tooth system 13' will therefore no longer be driven to rotate past this moment. However, the control wheel train (references 15, 16, 32, 33, 41, 42) described above, in particular on the basis of FIG. 2B, will still index the month gear 43 by a twelfth of a turn in direction S2, contrary to direction S1, during each passage from the 31st day to the 1st day of the following month. Moreover, the gear wheel 12, which will have performed a complete turn after meshing with the 7 teeth of the toothed meshing segment 11, will be held in position until the next meshing of this same meshing sector by the surface of the sector without teeth 11', visible in all the illustrations of FIGS. 5A and 5B, which blocks its rotation.

The reliability of the meshing proposed by the calendar mechanism according to the invention is improved compared to mechanisms using complex cam surfaces and/or movements with several components in translation for retractable teeth. Moreover, the construction is simplified by the use of planet gears that are all identical for each of the readjustments of the day of the month and of several coaxial and rotationally fixed program gears with similar tooth structures in their respective meshing level.

Moreover, it is evident that neither the gear wheel 12 nor the day program wheel 13 has long teeth, and this simplifies their machining. The preferably identical meshing sectors used for readjustment can be modularly mounted and positioned in their respective meshing level. Their depth as well as the number of teeth, which is doubled on each meshing sector 28, 29, 30 in relation to the corresponding superposed tooth 28", 29", 30" in meshing level A of the day index wheel 12, allows a good meshing reliability while the angular spacing between each of the meshing sectors itself assures unit incrementation of the day program wheel 13.

As can be seen in the view in FIGS. 5A and 5B, the readjustment for the missing days at the end of months of less than 31 days is conducted sequentially by the calendar mechanism according to the invention every hour over a period of 4 hours at maximum, i.e. from 20.00 to 24.00 hours, firstly in each of the 3 readjustment meshing levels E, B, D and then in the normal day indexing level C, while the gear wheel 12 is driven by the meshing sector of the 24-hour wheel 11. All the planet gears are driven by the same clock movement wheel train, and more precisely the same part (i.e. the day index wheel 12), such that there is no need for a dedicated wheel train for each correction, which simplifies the construction of the proposed calendar mechanism compared to classic mechanisms.

The number of teeth of the day index wheel 12, fixed at 8 according to the chosen preferred embodiment, has been determined to perform a rotation around a sufficient angle to index the day program wheel 13, on which planet gears 128, 129, 130 are mounted, by 1/31 of a turn, at the same time with an adequate meshing depth. In order to further increase the angular course during each meshing with the hour wheel, the number of teeth could be reduced further, e.g. to 6, or to 4 at maximum to integrate with a perpetual calendar mechanism, or 3 for an annual calendar mechanism, and this minimum number corresponds to the number of meshing sectors necessary for readjustment of the days of the month. Moreover, the fact that the day index wheel 12 makes precisely one complete turn each day enables a similar movement to be repeated by day cycles starting from the same position. However, in a variant it would also be conceivable for each of the meshing sectors to be repeated twice on the gear wheel 12, in such a manner that the toothed gear 12' could comprise 16 teeth, for example, with two identical patterns of 8 teeth comprising a series of two teeth in level A that are not superposed on meshing levels, then 4 teeth that are superposed on 4 meshing segments, and a last series of two teeth that are not superposed on meshing segments. In this case, the toothed gear 12' would make a half rotation each day instead of a complete rotation, which would limit the angular course during each indexing step of the gear wheel 12. The disadvantage of a gear wheel 12 with a toothed gear 12' with a larger number of teeth would be that more space would be occupied on the plate. However, it would be possible to combine the use of such a gear wheel 12, for example, with a 24-hour wheel with a larger number of teeth in order to conduct the readjustment of the days in a more restricted time span. Using a 24-hour wheel with 48 teeth, for example, with a meshing segment still with 7 teeth, the first, second, third and fourth meshing segments 29, 30, 31 and 28 would no longer mesh sequentially with the day program wheel 13 every hour, but every half hour in their respective meshing levels B, D, C, E, while the day meshing segment 11 would mesh with the toothed gear 12' of the gear wheel 12 so that the readjustment of the days at the end of the month would only take 2 hours at maximum instead of 4 according to the preferred embodiment illustrated on the basis of the previous figures.

The fact that the meshing levels B, D, E are separated for all readjustment operations at the end of the month and the meshing level of the day indexing operations C allows a modular replacement, preferably meshing level by meshing level, for each of the parts of the program wheel 100 and the gear wheel 12. This possibility provided by the calendar mechanism according to the invention is highly advantageous since meshing level C will be used every day, for example, while level B will be used once every year, level D 5 times a year and level E once a year three years out of four in non-leap years.

The calendar mechanism allows the day display to always be synchronised in relation to the movement, and, moreover, in both directions, such that an adjustment of the hour, classically by causing a crown arranged on the case 0 to rotate, will be transmitted to the hour wheel 1 and consequently to the calendar mechanism. This can be advantageous during a journey to a destination where the time zone is behind the region of origin, e.g. the west coast of the United States at 9 hours behind Europe. The user of a watch fitted with a calendar mechanism according to the invention will simply need to adjust the hour of his/her watch to −9 hours so that the day will automatically be adjusted backwards, e.g. from 1st March to 28th or 29th February, without requiring any dedicated handling for adjustment of the days of the month. Usage of the watch is only made easier in relation to watches provided with a usual day mechanism, for which no synchronisation with the movement is provided during adjustment in the reverse direction of operation.

What is claimed is:

1. A gear wheel for a clock mechanism, comprising:

a toothed gear provided with a homogeneous integral peripheral tooth system with at most 16 teeth in a first meshing level;

a first meshing sector that is rotationally fixed with said toothed gear and meshes in a second meshing level, wherein said first meshing level is superposed on a first tooth of said toothed gear;

a second meshing sector that is rotationally fixed with said toothed gear and meshes in a third meshing level, wherein said second meshing level is superposed on a second tooth of said toothed gear;

a third meshing sector that is rotationally fixed with said toothed gear and meshes in a fourth meshing level, wherein said third meshing level is superposed on a third tooth of said toothed gear.

2. The gear wheel for a clock mechanism according to claim 1, wherein said first tooth, second tooth and third tooth are arranged consecutively on said tooth system of said toothed gear.

3. The gear wheel for a clock mechanism according to claim 1, further comprising:

a fourth meshing sector that is rotationally fixed with said toothed gear and meshes in a fifth meshing level, wherein said fourth meshing level is superposed on a fourth tooth of said toothed gear.

4. The gear wheel for a clock mechanism according to claim 3, wherein said first tooth, second tooth, third tooth and fourth tooth are arranged consecutively on said tooth system of said toothed gear, and that the profile of said third tooth corresponds to the tooth system of said toothed gear.

5. The gear wheel for a clock mechanism according to claim 3 or 4, wherein said third and fifth meshing levels of said second and fourth meshing sectors, and respectively said second meshing level of said first meshing sector are located on either side of said fourth meshing level of said third meshing sector.

6. The gear wheel of a clock mechanism according to claim 5, wherein tooth systems of said first, second and fourth meshing sectors are identical.

7. The gear wheel for a clock mechanism according to claim 6, wherein the toothed gear comprises at most 8 teeth and meshes with a day meshing segment of a 24-hour wheel of said clock mechanism in such a manner that said toothed gear performs at most a complete rotation each day.

8. The gear wheel for a clock mechanism according to claim 7, wherein each of said meshing sectors is arranged to mesh with a day program wheel and to index said day program wheel by pitch by 1/31 of a turn.

9. The gear wheel for a clock mechanism according to claim 8, wherein said first, second, third and fourth meshing sectors of said gear wheel are arranged to mesh sequentially at least at one hour intervals with the day program wheel in said first, second, third and fourth meshing level while the day meshing segment of the 24-hour wheel meshes with said toothed gear of said gear wheel.

* * * * *